US006971963B2

(12) United States Patent
Abel

(10) Patent No.: US 6,971,963 B2
(45) **Date of Patent: *Dec. 6, 2005**

(54) WRIST TOY

(75) Inventor: Jeffrey T Abel, Missoula, MT (US)

(73) Assignee: Ketch-It Company, Spokane, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/772,156

(22) Filed: Feb. 3, 2004

(65) Prior Publication Data

US 2004/0192156 A1 Sep. 30, 2004

Related U.S. Application Data

(63) Continuation-in-part of application No. 10/116,838, filed on Apr. 5, 2002, now Pat. No. 6,685,582, which is a continuation of application No. 08/699,152, filed on Aug. 16, 1996, now Pat. No. 6,368,241.

(51) Int. Cl.[7] ..... A63B 43/00
(52) U.S. Cl. ..... 473/508; 473/576
(58) Field of Search ..... 473/506, 508, 473/424, 576

(56) References Cited

U.S. PATENT DOCUMENTS

| | | | | |
|---|---|---|---|---|
| 667,563 | A * | 2/1901 | Oakley | 473/424 |
| 795,960 | A * | 8/1905 | Cook | 473/424 |
| 3,843,126 | A * | 10/1974 | Bandy | 473/576 |
| 3,940,133 | A * | 2/1976 | Civita | 473/424 |
| 4,121,829 | A * | 10/1978 | Petrusek | 473/576 |
| 4,147,353 | A * | 4/1979 | Moore | 473/575 |
| 5,094,462 | A * | 3/1992 | Boyle et al. | 473/576 |
| 5,772,542 | A * | 6/1998 | Gildea et al. | 473/576 |
| 5,853,339 | A * | 12/1998 | Scerbo | 473/576 |
| 6,109,490 | A * | 8/2000 | Caluori | 224/220 |

* cited by examiner

*Primary Examiner*—John A. Ricci
(74) *Attorney, Agent, or Firm*—Fish & Richardson P.C.

(57) ABSTRACT

A toy with a springable cord and a ball. The toy has a wrist band, elastic cord and ball construction. The wrist band provides a way for minimizing twisting and knotting of the elastic band located at the base of the palm of the user. The construction of the elastic cord and ball provides a way for minimizing the degrading and wear contract of elastic cord with surfaces struck on the ball.

21 Claims, 3 Drawing Sheets

WRIST TOY

This is a continuation-in-part of U.S. patent application Ser. No. 10/116,838, filed Apr. 5, 2002, now U.S. Pat. No. 6,685,582, which is a continuation of U.S. patent application Ser. No. 08/699,152, filed Aug. 16, 1996, now U.S. Pat. No. 6,368,241.

BACKGROUND

THE FIELD OF THE INVENTION

The apparatus of the present invention is a toy. In particular, a toy employing an elastic cord is configured to minimize contact and abrasion of the elastic cord with the intended surface and employing means for preventing the elastic cord from knotting or twisting. Another aspect describes a connection to a larger in size and hollow ball.

THE RELEVANT TECHNOLOGY

Several tethered balls and recreational devices exist. U.S. Pat. No. 3,940,133, teaches an elastic cord attached to a ball using an embedded socket member in one end of the ball. The attachment to the ball employs a pivot mount.

U.S. Pat. No. 5,094,462 teaches a tethered soccer ball. A net is employed to surround the ball and to which an elastic cord is secured.

U.S. Pat. No. 3,843,126 teaches a tethered ball. An elastic band is attached at one end to a ball and on the other end to a flattened portion of a glove covering the palm and the back of the hand.

U.S. Pat. No. 4,836,555 teaches a combination glove and slap ball. A rubber band is attached at one end to a ball and to the other end to a disk anchor removably disposed in the glove.

U.S. Pat. Nos. 2,269,633 and 2,142,068 teach a toy. The toy employs an elastic strand attached at one end to a ball and attached at the other end to a disc or plate. A stirrup secured to the disc or plate is configured to receive the hand of the user.

U.S. Pat. No. 3,031,191 teaches a tethered ball game. A rubber band is secured at one end to a ball and is secured at the other end to a handle gripped by the user.

U.S. Pat. No. 3,635,476 teaches a pivotable target and ballstriking means. The ballstriking means comprises a ball which is connected to an elastic strand. The elastic strand is connected to a ringlike hand-clasping member.

U.S. Pat. No. 4,147,353 teaches a soccer ball retriever. The retriever includes an anchor stake, a cord and a ball holder. The cord comprises an elastic member and a braided nylon member. The cord is disposed between the ball holder and the anchor. A hook and swivel connect the cord to the anchor stake.

U.S. Pat. No. 4,601,474 teaches a self-retrieving attack ball. A spool rotatable about a shaft is disposed with the ball. Two spiral springs act against the spool. A cord is wound about the spool such that when the ball is thrown and the free end of the cord is retained, the cord unwinds from the spool, when the momentum of the ball no longer overcomes the spiral springs, or when the ball strikes an object, the spiral springs recoil the spool winding the cord up inside the ball.

U.S. Pat. No. 5,083,797 teaches a game ball training apparatus/carrier. The apparatus includes a handle, an inelastic cord and an inelastic ball net. The inelastic cord is fastened at one end to the handle and the other end is looped through the net.

SUMMARY AND OBJECTS OF THE INVENTION

The present invention is directed to a novel retrievable toy. The ball can be thrown against walls or floors or simply to a distance until the length of the elastic cord causes the ball to rebound. One aspect is directed to development of eye-hand coordination. That is, the toy may be preferably thrown and caught by the same hand.

One aspect describes minimizing interference caused by the cord when the ball is thrown and during the rebound travel of the ball. Because the ball of the present invention can and does strike wall and/or floors, it is also important to provide a construction which will minimize degrading wear of the elastic cord.

A wrist toy comprises a wrist band, an elastic cord member and a ball. The elastic cord member is attached directly to the ball employing means for minimizing contact of the elastic cord with the floor or wall. The wrist band comprises a webbed band secured about the limb of the user. The wrist band is provided with means for receiving the elastic member and for avoiding or minimizing the twisting or knotting of the entire length of the elastic cord and ball.

In an embodiment, the means for minimizing contact of the elastic cord with the floor or wall is accomplished by passing the elastic member directly through only a portion of the ball, not necessarily through the center or along a central axis of the ball. A preferred structure of the means to avoid or minimize the twisting or knotting of the entire length of the elastic cord and ball employs a freely rotating swivel releasably connected to the wrist band. A novel feature of the present invention is the position of the freely rotating swivel located on the wrist of the user so as to be at the base of the hand of the user.

An advantage and object of the present invention over the cited prior art is that the rebounding of the ball is directed to the hand of the user while avoiding or minimizing the twisting or knotting of the entire length of the elastic member.

Another aspect describes an inflatable ball ussed in such a system, including an attachment mechanism to the inflatable ball.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION

Figure 1:
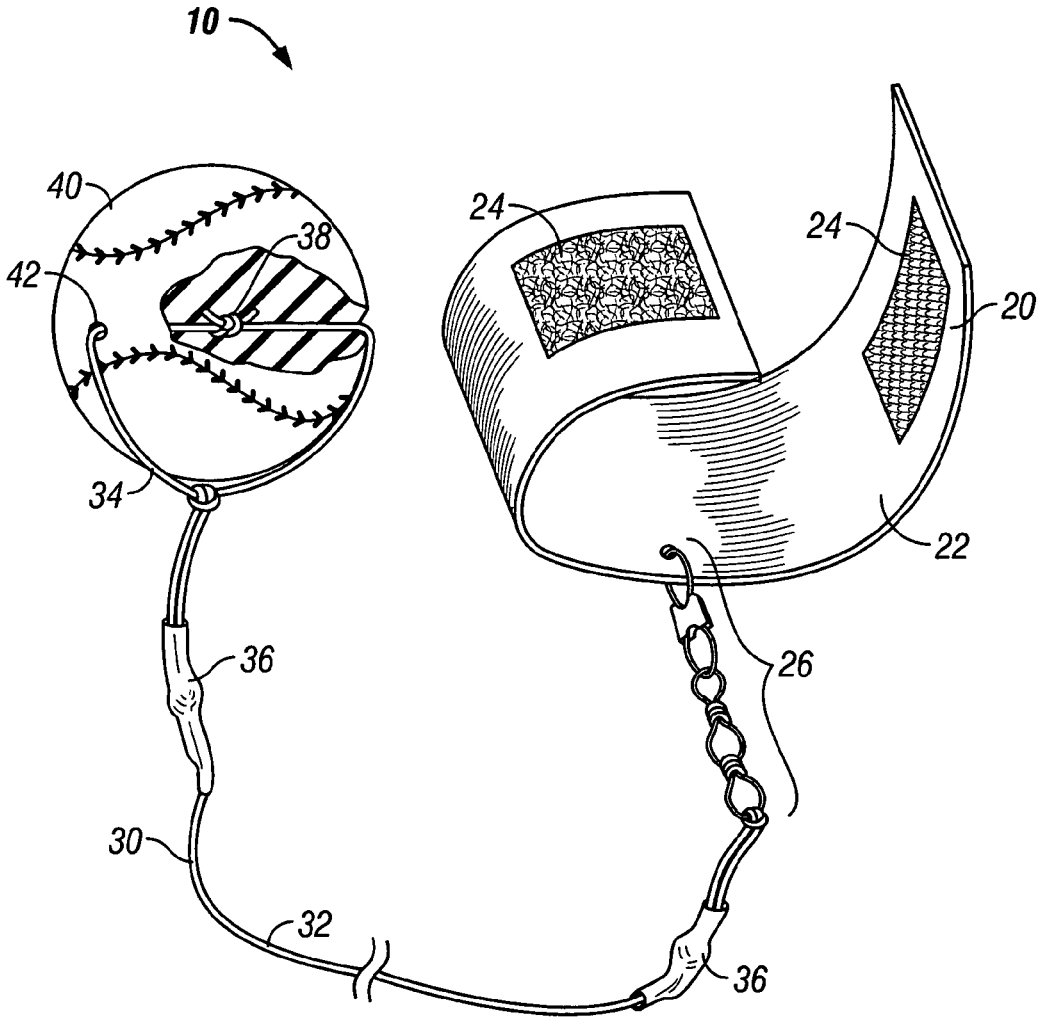
FIG. 1 is a perspective view of one embodiment of the retrievable toy of the present invention.

In the drawings a preferred embodiment 10 of the toy apparatus is shown. Apparatus 10 comprises wrist band 20, elastic member 30 and ball 40.

Wrist band 20 comprises a length of nylon webbing 22 to encircle the limb of the user. Means 24 for fastening wrist band 20 may include any conventional fastening means. FIG. 1 illustrates the use of conventional hook and pile fastening means. Hook and pile is preferred because it is adjustable to different size wrists. Snaps, buttons or other adjustment or fastening means may provide equivalent function.

Wrist band 20 also comprises means for avoiding or minimizing the twisting or knotting of the entire length of the elastic cord and ball. The preferred embodiment of the means for avoiding or minimizing the twisting or knotting of the entire length of the elastic cord comprises a freely rotatable swivel 26. Swivel 26 is releasably attachable to webbing 22. In order to optimize the rebound of ball 40 to the hand of the user, swivel 26 is attached to an edge of webbing 22. This provides the user with the advantage of being able to wear wrist band 20 such that swivel 26 is positioned just at the base of the user's palm. Attaching swivel 26 at the edge of the webbing 22 also advantageously minimizes any interference of the rotating action of swivel 26 and, hence, of the entire length of elastic member 30.

Figure 2:
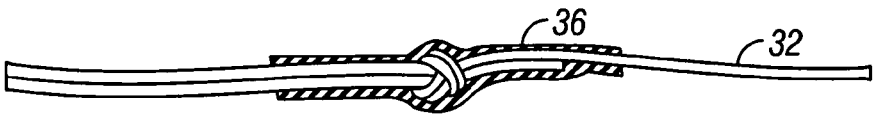
FIG. 2 is a detailed view of a transition length of an elastic band employed by the present invention.
Figure 3:
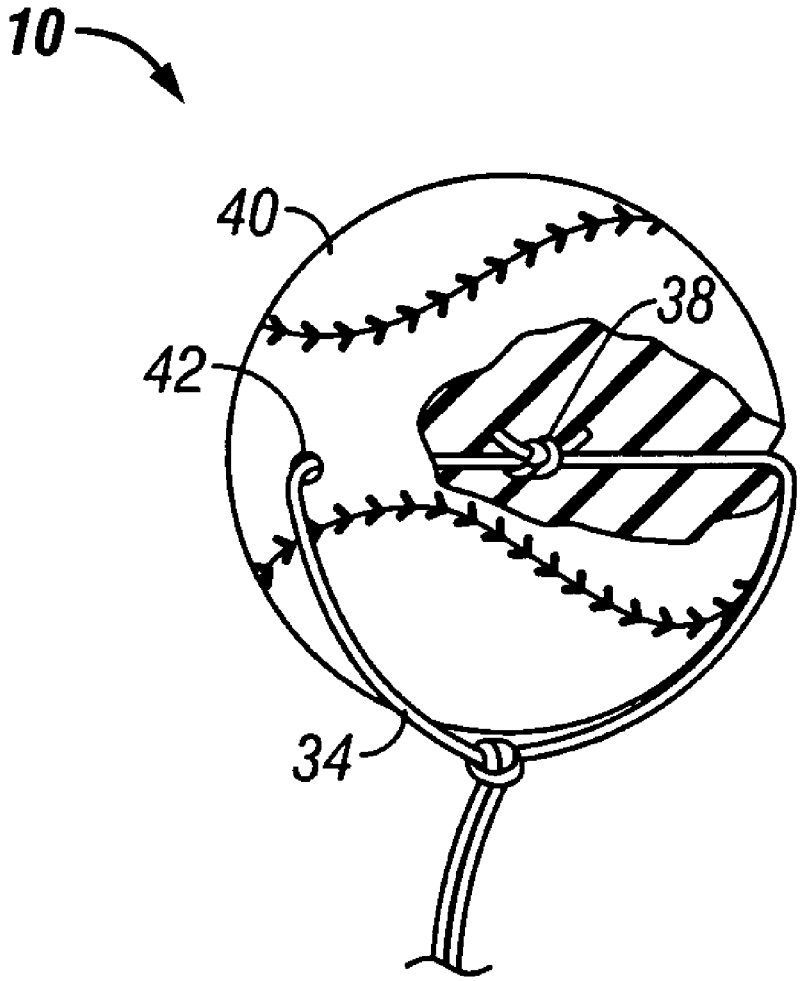
FIG. 3 shows a detailed connection to the ball.

Elastic member 30 comprises two members, elastic rebounding cord member 32 and means 34 for minimizing contact of the elastic cord with the floor or wall. Elastic cord 32 provides the retrieving, rebounding effect needed. Cord 32 is attached directly to swivel 26 at one end and to the means 34 for minimizing contact of the elastic cord with the floor or wall at the other end. To optimize the endurance of cord 32 and to prevent any scratching to the user, sleeve 36 may shroud the knots and ends of cord 32. FIG. 2 shows one embodiment of how sleeve 36 shrouds the knots and ends of cord 32.

The preferred embodiment of means 34 for minimizing contact of the elastic cord with the floor or wall comprises attachment member 34. Attachment member 34 may be made of the same material as cord 32. However, the preferred embodiment of attachment member 34 comprises a flat elastic construction so that it lies flatter against ball 40. Attachment member 34 is connected to ball 40 by passing a portion of attachment member 34 through a bore 42 in ball 40. It is preferred to tie a knot 38 in attachment member 34 and to draw knot 38 inside ball 40. Bore 42 may pass through an axis of ball 40. However, in the preferred embodiment, bore 42 passes through a portion of ball 40 not along an axis of ball 40 such that a larger continuous surface of ball 40 is free of the attachment member 34, thereby minimizing the contact of attachment member 34 with contact surfaces such as floors and/or wall. In this way, when thrown, a larger mass of the ball is the leading portion of ball 40 which ultimately contacts a floor or wall thereby minimizing contact of attachment member 34 or cord 32 with a floor or wall.

Ball 40 comprises any ball. Preferably ball 40 comprises a rubber or spongy ball which can be adapted with a bore 42 to receive member 34. For example, ball 40 can be made of a soft material which deforms upon impact to absorb impact energy but which material is sufficiently elastic such that the ball after impact and recoil transforms back to is preimpact shape. Preferably ball 40 is of a weight which when thrown is not significantly hindered by elastic member 30.

It will be appreciated that wrist band 20, elastic member 30 and ball 40 may be manufactured in any color or combination of colors as desired.

Figure 4:
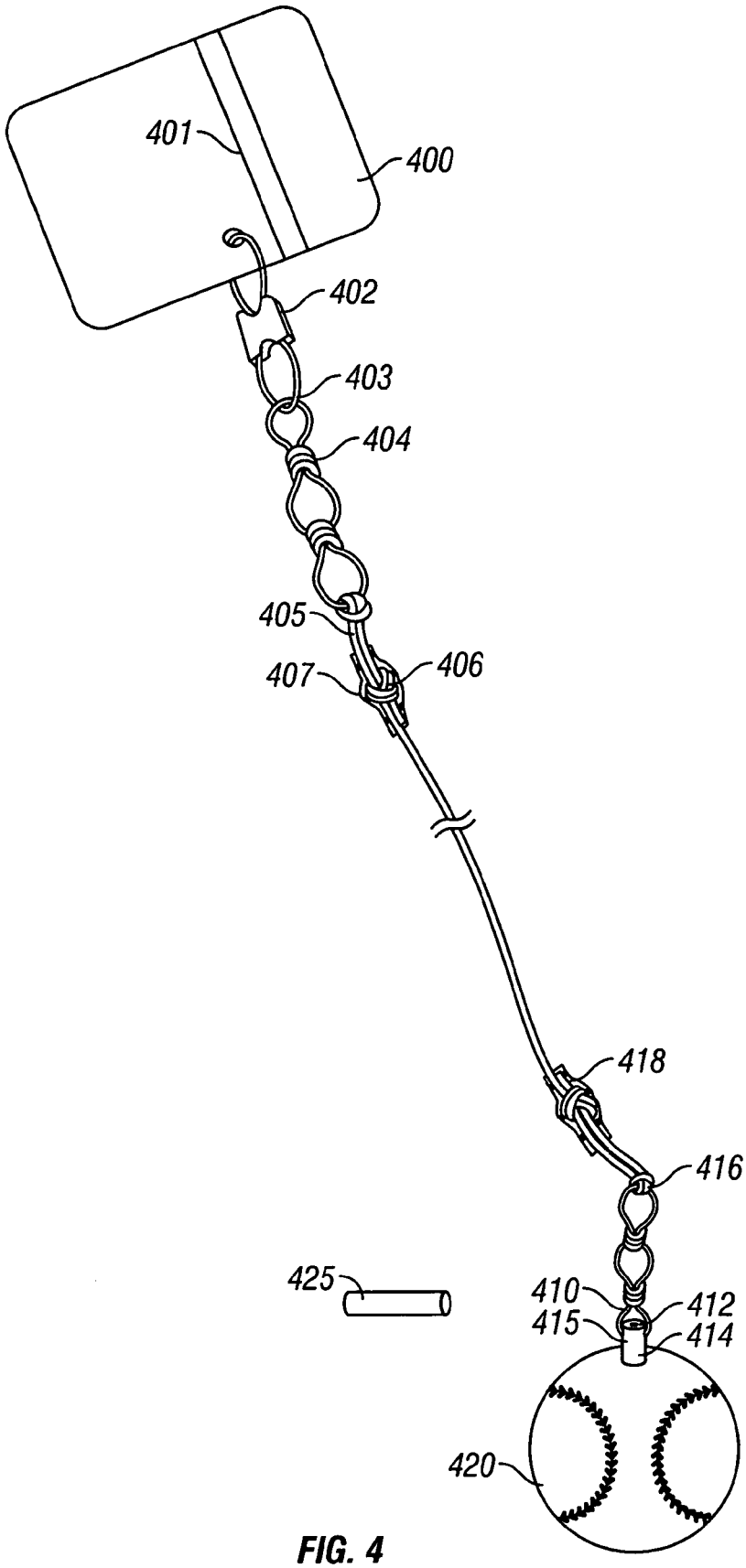
FIG. 4 shows a detail of another embodiment in which a larger in size, blowup ball, is used.

An alternative embodiment is shown in FIG. 4. This embodiment is similar to the previous embodiments, however uses an inflatable ball 420. The previous embodiment, which used a pre-formed ball, fit the pre-formed ball into a package which was intended to be placed on a shelf. Making the ball larger became problematic; simply because of packaging. By using an inflatable ball, any arbitrary sizable can be used without significantly increasing the package size.

A new connection to this inflatable ball, one which also serves as a stopper for the air, is also disclosed. The wrist strap 400, more generally a limb strap, includes a swivel connection 402 as in the first embodiment, connected to an elastic cord 405. The elastic cord 405 passes through the swiveling end 403 of the swivel, and is also knotted there at 404. The elastic cord is also knotted at 406, where the free end, that has passed through the swiveling portion 403, is knotted to the main portion of the cord 405. The knotted portion 406 is covered by a shrink-wrapped sleeve 407.

The elastic cord is also connected to a connection mechanism on the ball 420. The connection mechanism on the ball includes a ring portion 410 molded to a stopper portion 412. The bottom portion 414 of the stopper mates to an air intake opening, e.g., a hole 419 in the inflatable ball 420, and is beveled to form a variable diameter cylinder, with a smaller diameter on its bottom. The cylinder is placed into the hole 419 in the ball, and holds the air therein.

The ball may also be provided with an air inflation mechanism 425, e.g., a straw which fits into the hole 419. The ball can be inflated through the straw, and then the surfaces 415 of the beveled stopper portion are placed into the hole 419, and act as a stopper to hold the air therein.

Therefore, the stopper portion has two functions: the surfaces 415 hold the air in the ball, and in addition, the top portion of stopper portion includes a ring connecting mechanism 410 which provide a ring-shaped surface allowing connection to the elastic cord without presenting any sharp edges.

The elastic cord is routed through the connecting mechanism 410, and also knotted at 416. The cord passes back and is knotted again at 418. The portions of the cord which are knotted may be covered with shrinkable tubing which has been shrunk.

The shrinkable tubing has two functions: first, it can prevent wear on those portions of the cord. In addition, since the tubing is shrunk, it aids in structurally holding the different cord portions in place.

In operation, the user attaches the wrist band to their wrist or other limb, and uses the Velcro closure 412 to attach the band more tightly. Then, the user can kick the ball, and the force of the kick causes the ball to move, until the extended cord is elastically stressed enough to counteract the force of the ball. At that point, the ball springs back so that the user can kick it again.

Modifications of this system are also possible. For example, this system may operate properly without the swivel, having the elastic cord connected directly to the wrist portion. In addition, the ball need not be inflatable, and rather can be a solid material. While the above has described the ball attachment part also having surfaces used to hold the air within the ball, a separate plug can be used, and another attachment part can be formed on the surface of the ball. While the above has described the wrist portion being formed of Velcro, it is also should be apparent that the wrist portion could be formed of other materials such as elastic which can expand to allow placing over the user's hand, and then contract to hold on the user's wrist.

All such embodiments are intended to be encompassed within the following claims:

What is claimed is:

1. An apparatus, comprising:

a spherical ball having a connection portion thereon;

a limb attachment mechanism, having inner surfaces which can be changed in shape to attach to a users limb, and having a connection part, enabling connection to said limb attachment mechanism, said limb attachment mechanism formed of a flexible material, and said connection part including a rigid portion;

a first elastic cord, coupled between said rigid connection portion and said spherical ball, and including at least one connection knot therein which connects different parts of said first elastic cord to one another, said at least one connection knot including a sleeve formed of shrinkable material that is shrunk to cover said cord and said knot covering an outer surface of the connection knot.

2. An apparatus as in claim 1, wherein said rigid connection part include a rigid swivel.

3. An apparatus as in claim 1, wherein said sleeve also covers an end portion of said first elastic cord.

4. An apparatus as in claim 3, wherein said ball includes a bore extending therethrough, and further comprising a connection cord, connected through said bore of said spherical ball, and connected to said first elastic cord at said connection knot.

5. An apparatus as in claim 4, further comprising a second knot, in said connection cord, at an area where two parts of said connection cord contact with one another on an outside of said ball.

6. An apparatus as in claim 1, further comprising a second elastic part, coupled by a second knot to said connection part at a first end, and coupled by a third knot to said first elastic cord at a second end, and a second sleeve, covering a free end of said second elastic part, a free end of said first elastic part, and said third knot.

7. An apparatus, comprising:

a limb attachment part, having inner surfaces adapted for attachment to a user's wrist and capable of attaching around the user's wrist and having a first attachment portion therein;

a spherical ball, having inner surfaces which contain air therein, and having an air intake opening which includes a second attachment portion on an upper surface thereof formed of a portion with inner surfaces allowing attachment thereto and a beveled cylindrical portion on a bottom portion of said second attachment portion, having cylindrical outer surfaces which press against inner surfaces of said air intake opening, to plug said air intake opening in an airtight manner; and an elastic cord, connected between said first attachment portion and said second attachment portion, allowing said spherical ball to be elastically connected to said limb attachment part.

8. An apparatus as in claim 7, wherein said limb attachment part has a variable diameter of a size adapted for holding against a user's wrist.

9. An apparatus as in claim 8, wherein said limb attachment part has hook and pile material which allows changing a diameter thereof.

10. An apparatus as in claim 7, further comprising a swivel mechanism, connected between said wrist attachment part, and said elastic cord, and allowing swiveling therebetween.

11. An apparatus as in claim 7, wherein said air intake opening is substantially round.

12. An apparatus as in claim 11, wherein said inner surfaces of said second attachment portion includes a portion with no sharp edges thereon, connected to a top portion of said second attachment portion.

13. An apparatus as in claim 12, wherein said bottom portion of said second attachment portion includes a beveled cylinder, which is widest in diameter at its top part, and is narrowest in diameter in its bottom part, and wherein said narrowest diameter portion fits within said air intake opening.

14. An apparatus as in claim 7, wherein said elastic cord is knotted on both said first attachment portion and said second attachment portion.

15. An apparatus as in claim 14, wherein said elastic cord passes through said each of said first and second attachment portions, and is also knotted at a first location near said first attachment portion and at a second location near said second attachment portion.

16. An apparatus as in claim 7, further comprising at least one knot in said elastic cord, and at least one shrinkable sleeve, over said at least one knot and shrunk thereagainst.

17. An apparatus as in claim 15, further comprising at least one shrinkable sleeve, covering at least one of said knots and shrunk thereagainst.

18. A toy, comprising:

a spherical inflatable ball, having an outer surface formed of a flexible material, and having a first portion with a hole formed therein, said hole being substantially of a circular shape, and having inner surfaces formed of a material which can be plugged; and a plug assembly, having a first portion formed of a beveled cylinder with a bottom part that fits within said inner surfaces of said hole, a top part which is sufficiently large as to plug said inner surfaces of said hole when depressed therein, and also includes a connection portion thereon, which has no sharp edges thereon.

19. A toy as in claim 18, further comprising an elastic cord, connected to said top part of said plug assembly.

20. A toy as in claim 19, further comprising a limb attachment part, having inner surfaces adapted for placing around the user's limb, and including a cord attachment part thereon, said cord attachment part connected to another end of said elastic cord.

21. A toy as in claim 20, wherein said cord attachment part includes a swivel.

* * * * *